US005388651A

United States Patent [19]

Berry

[11] Patent Number: 5,388,651

[45] Date of Patent: Feb. 14, 1995

[54] TOP DRIVE UNIT TORQUE BREAK-OUT SYSTEM

[75] Inventor: Joe R. Berry, The Woodlands, Tex.

[73] Assignee: Bowen Tools, Inc., Houston, Tex.

[21] Appl. No.: 50,537

[22] Filed: Apr. 20, 1993

[51] Int. Cl.[6] ..... E21B 19/00

[52] U.S. Cl. ..... 175/85; 175/113; 175/162; 175/195; 175/122

[58] Field of Search ..... 175/85, 113, 162, 170, 175/195, 122

[56] References Cited

U.S. PATENT DOCUMENTS

| | | | |
|---|---|---|---|
| 1,377,575 | 5/1921 | Greve . | |
| 2,792,198 | 5/1957 | Braun | 255/19 |
| 2,998,084 | 8/1961 | Johnson et al. | 175/85 |
| 3,009,521 | 11/1961 | Failing | 175/127 |
| 3,053,330 | 9/1962 | Arthur | 175/170 |
| 3,126,063 | 3/1964 | Pitt et al. | 173/152 |
| 3,404,741 | 10/1968 | Gheorghe et al. | 175/85 |
| 3,451,493 | 6/1969 | Storm | 175/9 |
| 3,539,024 | 11/1970 | Irons et al. | 175/85 |
| 3,664,439 | 5/1972 | Council | 175/85 |
| 3,680,412 | 8/1972 | Mayer et al. | 81/57.34 |
| 3,708,024 | 1/1973 | Back | 175/52 |
| 3,835,940 | 9/1974 | Winter, Jr. | 175/85 |
| 3,874,196 | 4/1975 | Hisey et al. | 175/195 X |
| 3,915,244 | 10/1975 | Brown, deceased | 175/85 |
| 3,920,087 | 11/1975 | Hisey et al. | 175/85 X |
| 3,994,350 | 11/1976 | Smith et al. | 175/85 |
| 4,195,698 | 4/1980 | Nakagawasai | 173/44 |
| 4,262,754 | 4/1981 | Nelson | 173/43 |
| 4,421,179 | 12/1983 | Boyadjieff | 173/44 |
| 4,449,596 | 5/1984 | Boyadjieff | 175/85 |
| 4,529,045 | 7/1985 | Boyadjieff et al. | 173/164 |
| 4,589,503 | 5/1986 | Johnson et al. | 175/85 X |
| 4,605,077 | 8/1986 | Boyadjieff | 175/85 |
| 4,667,752 | 5/1987 | Berry et al. | 175/85 |
| 4,753,300 | 6/1988 | Shaw et al. | 173/164 |
| 4,800,968 | 1/1989 | Shaw et al. | 175/85 |
| 4,809,792 | 3/1989 | Lynch | 175/113 |
| 4,813,493 | 3/1989 | Shaw et al. | 173/164 |
| 4,813,498 | 3/1989 | Lynch et al. | 175/113 |
| 4,821,814 | 4/1989 | Willis et al. | 173/164 |
| 4,865,135 | 9/1989 | Moses | 175/57 |
| 4,867,236 | 9/1989 | Haney et al. | 166/77.5 |
| 4,878,546 | 11/1989 | Shaw et al. | 173/163 |
| 4,981,180 | 1/1991 | Price | 173/164 |
| 5,107,940 | 4/1992 | Berry | 175/85 |
| 5,251,709 | 10/1993 | Richardson | 175/85 X |

*Primary Examiner*—Roger J. Schoeppel

*Attorney, Agent, or Firm*—Pravel, Hewitt, Kimball & Krieger

[57] ABSTRACT

A torque break-out system for a top drive drilling unit in a drilling rig. The torque break-out system includes a splined sub which is connected to a tubular member of the top drive drilling unit. A collar is positioned circumferentially around the splined sub. The collar has a plurality of interrupted splines in reciprocal relationship to interrupted splines on the splined sub. The collar is positioned by a pivot member having a pair of arms rotatably connected to the collar and a lift cylinder connected to the pivot member. The lift cylinder positions the pivot member between a first position in which the interrupted splines of the splined sub and the collar are not in substantial horizontal alignment and a second position in which the interrupted splines of the splined sub and the collar are in substantial horizontal alignment. The system includes a back-up wrench assembly having a vertical opening through which the drill string is received. A pair of extendible rams are attached to the back-up wrench assembly. A plurality of dies are attached to the rams. The rams are capable of extending towards the drill string so that the drill string is grippingly engaged by the plurality of dies. A torque member is non-rotatably connected to the back-up wrench assembly and to a cylinder pivot member. Rotation of the top drive unit relative to the drill string is accomplished by positioning the collar such that the interrupted splines of the splined sub and the collar are in horizontal alignment with each other.

29 Claims, 7 Drawing Sheets

TOP DRIVE UNIT TORQUE BREAK-OUT SYSTEM

BACKGROUND OF THE INVENTION

1. Field Of The Invention

The present invention relates to top drive drilling units and particularly, a torque system for transmitting torque to break-out the upper pipe joint in the drill string from the top drive drilling unit.

2. Description of the Related Art

In the past decade, top drive drilling units have begun replacing the conventional rotary drilling units in the drilling industry. In a top drive drilling unit, the usual rotary table, kelly, and related equipment are substituted with an assembly which is connected to the upper end of the drill string which moves upwardly and downwardly in the derrick with the drill string. A drilling motor is connected to the drill string by a cylindrical stem and saver sub assembly extending downwardly from the drilling motor.

Drilling is accomplished by the powered rotation of the drill string. The drill string consists of threadably connected joints of drill pipe which are each about thirty feet long. Each end of each joint is threaded. One end has threads cut inside, and the other end is threaded on the outside. The inside threaded end is referred to as the "box," and the outside threaded end is the "pin." The threaded ends on the pipe joint are called tool joints. Tool joints are usually welded onto the ends of the tubular drill pipe body. When a drill string is made up, i.e., a series of pipe joints threadably connected, the pin is stabbed into the box and the connection tightened.

During the drilling operation, it may become necessary or desirable to disconnect or break-out the top drive drilling unit from the drill string at a point at which the threaded connection between the top drive drilling unit and the drill string are high above the drill floor of the drilling rig. The normal tools to disconnect the tightly threaded connection are heavy and large such that it is impractical to use them at any location other than the drill floor. Furthermore, it would be extremely dangerous for a worker to attempt to climb up the derrick and apply tools and the necessary torque to disconnect the joint.

It is desirable to be able to remotely disconnect the top drive drilling unit from the drill string at any height above the drill floor of the drilling rig. It is further desirable to have an apparatus which is quick and reliable and can be integrated into the top drive drilling unit to apply the required torque.

SUMMARY OF THE PRESENT INVENTION

Briefly, the present invention is a torque break-out system for a top drive drilling unit. The break-out system can remotely disconnect the top drive drilling unit from the drill string at any height above the drill floor of the drilling rig. The break-out system is quick and reliable and can be integrated into the top drive drilling unit to apply the required torque. The system can be operated from the drill floor of the drilling rig.

The torque break-out system includes a torque device having a splined sub having a plurality of interrupted splines. The splined sub is connected to a power swivel stem of the top drive drilling unit. A collar is positioned circumferentially around the splined sub. The collar has a plurality of interrupted splines in reciprocal relationship to the interrupted splines on the splined sub. The collar is vertically positioned by a pivot member having a pair of arms rotatably connected to the collar and a lift cylinder connected to the pivot member. The lift cylinder positions the pivot member between a first position in which the interrupted splines of the splined sub and the collar are not in substantial horizontal alignment and a second position in which the interrupted splines of the splined sub and the collar are in substantial horizontal alignment.

The torque break-out system includes a back-up wrench assembly having a vertical opening through which the drill string is received. Extendible rams are attached to the back-up wrench assembly. A plurality of dies are attached to the rams. The rams are capable of extending towards the drill string until the drill string is grippingly engaged by the plurality of dies.

A torque member having an upper end and a lower end is non-rotatably connected to the back-up wrench assembly at the lower end. The upper end of the torque member is non-rotatably connected to a cylinder pivot member. The torque break-out system further includes first and second torque cylinders each having a first end connected to the cylinder pivot member and a second end connected to the collar.

Rotation of the top drive unit stem and saver sub relative to the drill string is accomplished by positioning the collar such that the interrupted splines of the splined sub and the collar are in horizontal alignment with each other. With the dies of the back-up wrench assembly firmly engaging the drill string, torque is applied by the torque cylinders to rotate the collar which, in turn, rotates the splined sub relative to the drill string below.

BRIEF DESCRIPTION OF THE DRAWINGS

In order to more fully understand the drawings referred to in the detailed description of the present invention, a brief description of each drawing is presented, in which.

DETAILED DESCRIPTION OF INVENTION

Figure 1:
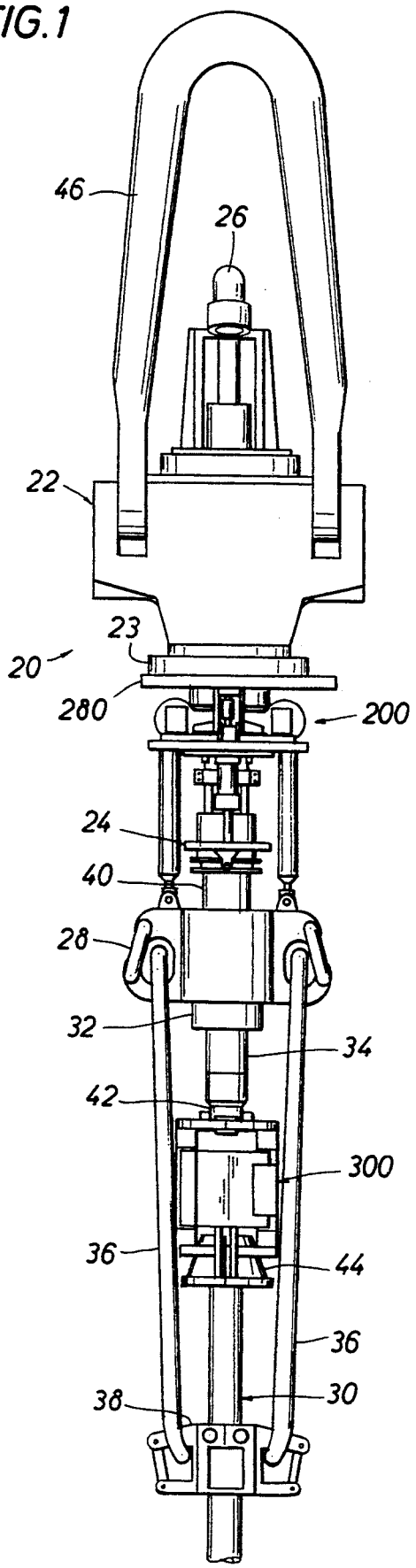
FIG. 1 is a front elevational view of a top drive drilling unit and the torque break-out system according to the present invention.
Figure 2:
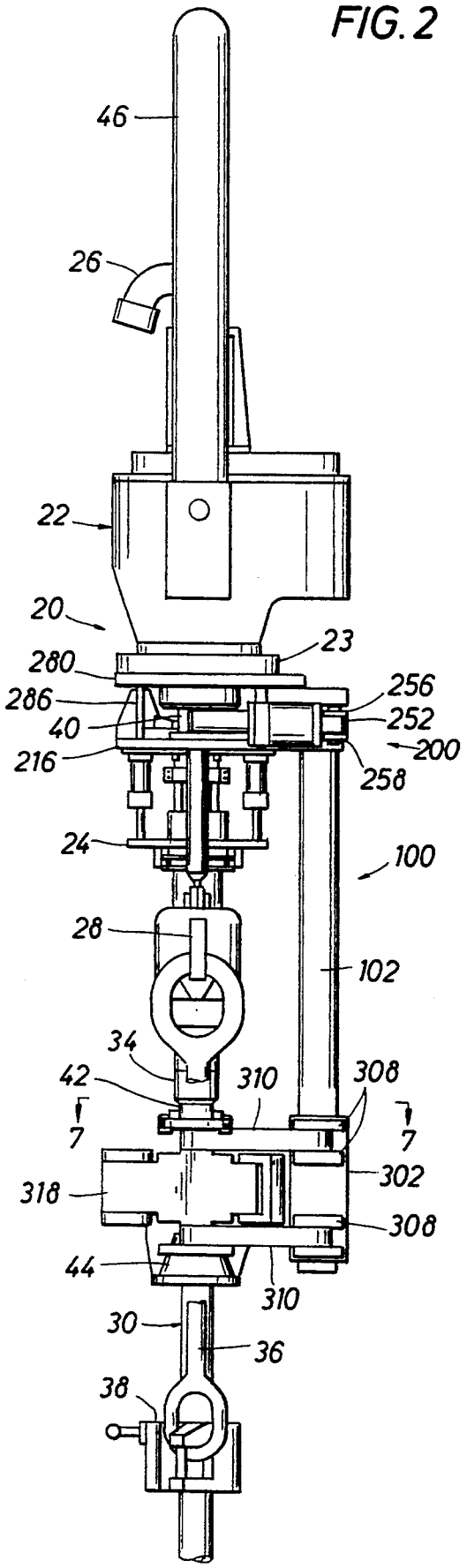
FIG. 2 is a side elevational view of the top drive drilling unit and the torque break-out system.

Referring to FIGS. 1 and 2, the top drive drilling system, generally designated as 20, is adapted to be suspended from a hook of a traveling block and hook assembly of a typical drilling rig (not shown) as is well known in the field. Although well known in the field, the primary components and operation of the top drive drilling system 20 will be briefly discussed. The top drive drilling system 20 includes a power swivel 22 and a kelly safety valve assembly 24. The power swivel 22 and the kelly safety valve assembly 24 are conventional equipment in the drilling industry.

The power swivel 22, illustrated in FIGS. 1 and 2, is a conventional hydraulic motor-driven, pipe rotating device which supports hoisting and dynamic loads associated with a drill string 30. The power swivel 22 incorporates a goose-neck and washpipe assembly 26 which allows drilling fluid circulation through a lower power swivel stem 40 and the drill string 30 while in the static, or non-rotating, condition or while rotating the swivel stem 40 and the drill string 30. A variable volume pump and hydraulic system or an electric drive or other mechanical device (not shown) allows the torque and speed to be varied with no need to shift gears or stop and restart the unit to increase or decrease speed. As above indicated, the power swivel is conventional equipment. Additional details regarding the function, connection, and operation of the power swivel 22 may be found in U.S. Pat. No. 5,107,940 to Berry for "Top Drive Torque Restraint System" which is hereby incorporated by reference.

The conventional remote kelly safety valve assembly 24, as shown in FIGS. 1 and 2, is used to open and close a conventional kelly safety valve. The remote kelly safety valve actuator 24 is controlled by the driller from the driller's control console (not shown). The kelly safety valve is always present in the traveling drill string 30 for immediate response to well control procedures.

Figure 3:
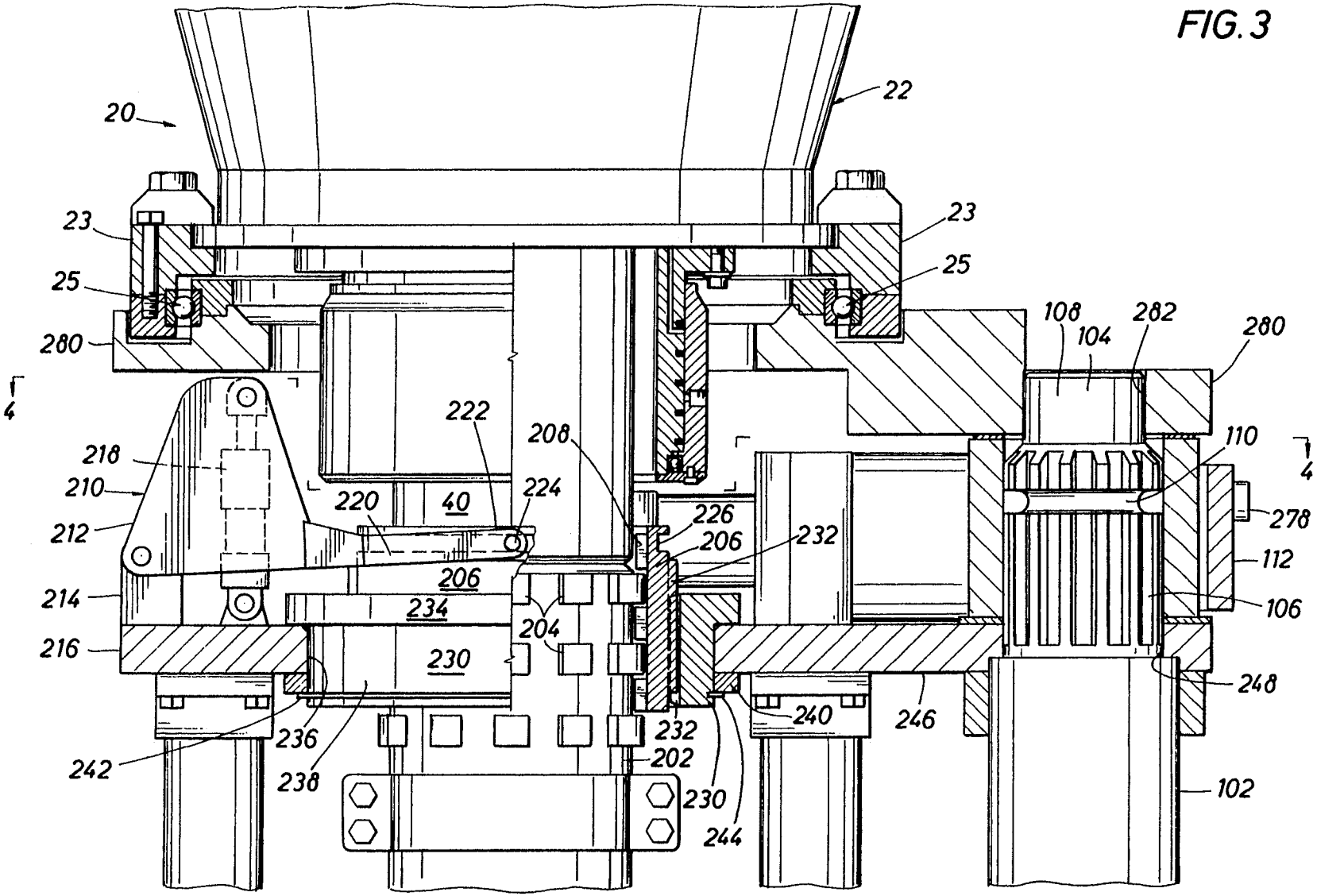
FIG. 3 is a side elevational view in partial section of the upper portion of the torque break-out system.

Referring to FIGS. 1 and 2, the top drive drilling system 20 includes a link adaptor and hoisting system comprising a link adaptor 28, load collar 32, a pair of long links 36, and an elevator 38. The link adaptor 28 transfers the weight of the drill string 30 to the power swivel stem 40. The link adaptor 28 lands out on the load collar 32 which is attached to an interrupted splined sub 202 (FIG. 3) according to the present invention. Referring to FIG. 3, the interrupted splined sub 202 is threadably made up to the power swivel stem 40. Referring to FIGS. 1 and 2, the link adaptor 28 is held above the load collar 32 by the link adaptor compensating system when a lower saver sub 42 is connected to the drill string 30, thus preventing rotation of the link adaptor 28 and elevator 38 during drilling operations. When the drill string 30 is being supported through the elevator 38, the link adaptor 28 is allowed to rotate on the power swivel 22.

As shown in FIGS. 1 and 2, a split stabbing bell 44 is located around the connection of the lower saver sub 42. The split stabbing bell 44 guides a pin (not shown) of the lower saver sub 42 into a box of the pipe joint being added to the drill string 30. The lower saver sub 42 is the lowermost connection in the top drive drilling system 20. The saver sub pin is formed to engage the drill string connections.

At the upper end of the top drive drilling system 20, the power swivel 22 is suspended from a hook (not shown) of a traveling block (not shown) by a typical bail 46.

Having thus described the typical top drive drilling system 20, the torque break-out system according to the present invention, designated generally as 100, will now be described in detail.

Referring to FIGS. 1 and 2, the torque break-out system 100 includes a torque tube 102 which is connected at its upper end to a torquing device assembly 200 and at its lower end to a back-up wrench assembly 300.

Referring to FIG. 3, the power swivel stem 40 of the power swivel 20 is permitted to rotate relative to the housing of the power swivel 20. The power swivel stem 40 has a lower box which threadably mates with a pin of the interrupted splined sub 202. The interrupted splined sub 202 has a series of interrupted splines 204 uniformly spaced around the periphery of the interrupted splined sub 202. The interrupted splined sub 202 is surrounded by an interrupted splined collar 206 having a series of interrupted splines 208 uniformly spaced around the internal periphery of the interrupted splined sub 202. The interrupted splines 204 and 208 are spaced such that the collar 206 can be vertically raised to a first position in which the collar splines 208 are vertically positioned between the sub splines 204 and do not engage the sub splines 204 when the interrupted splined sub 202 is rotated by the power swivel 20. In a second position, the collar splines 208 are horizontally positioned adjacent the sub splines 204 to cause an interference fit such that rotation of the collar 206 causes the interrupted splined sub 202 also to rotate.

Figure 4:
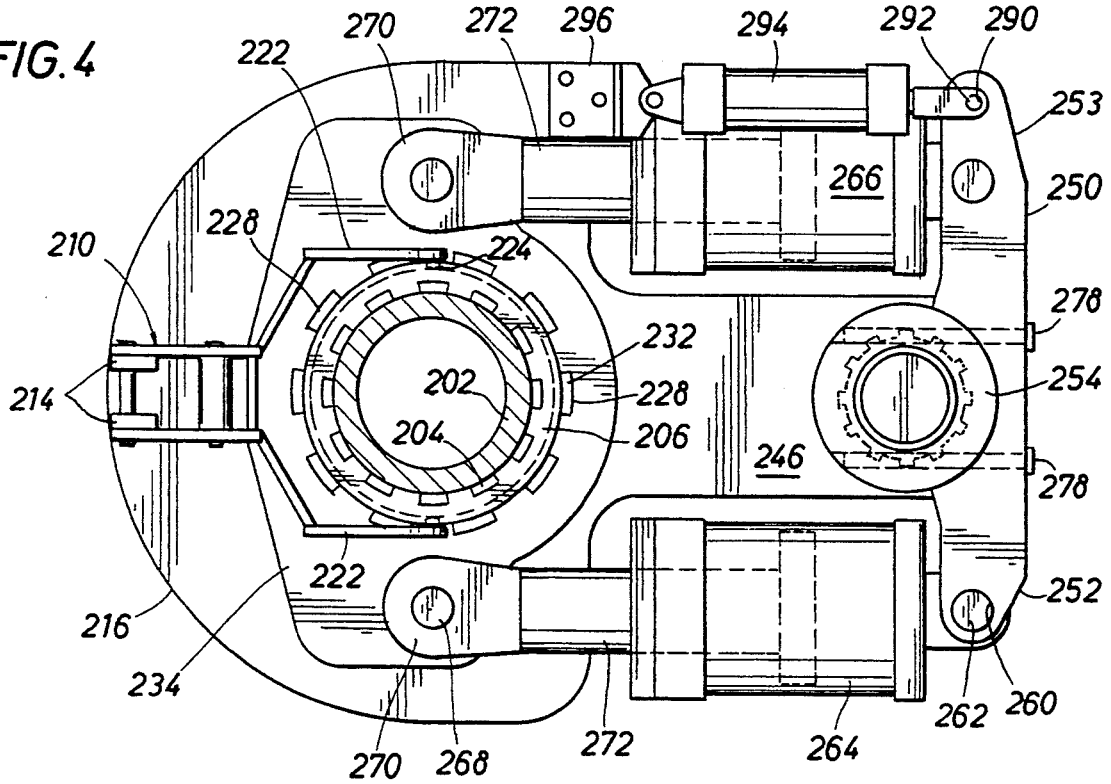
FIG. 4 is a view taken along line 4—4 of FIG. 3 showing the position of the torquing device assembly while breaking the joint.
Figure 5:
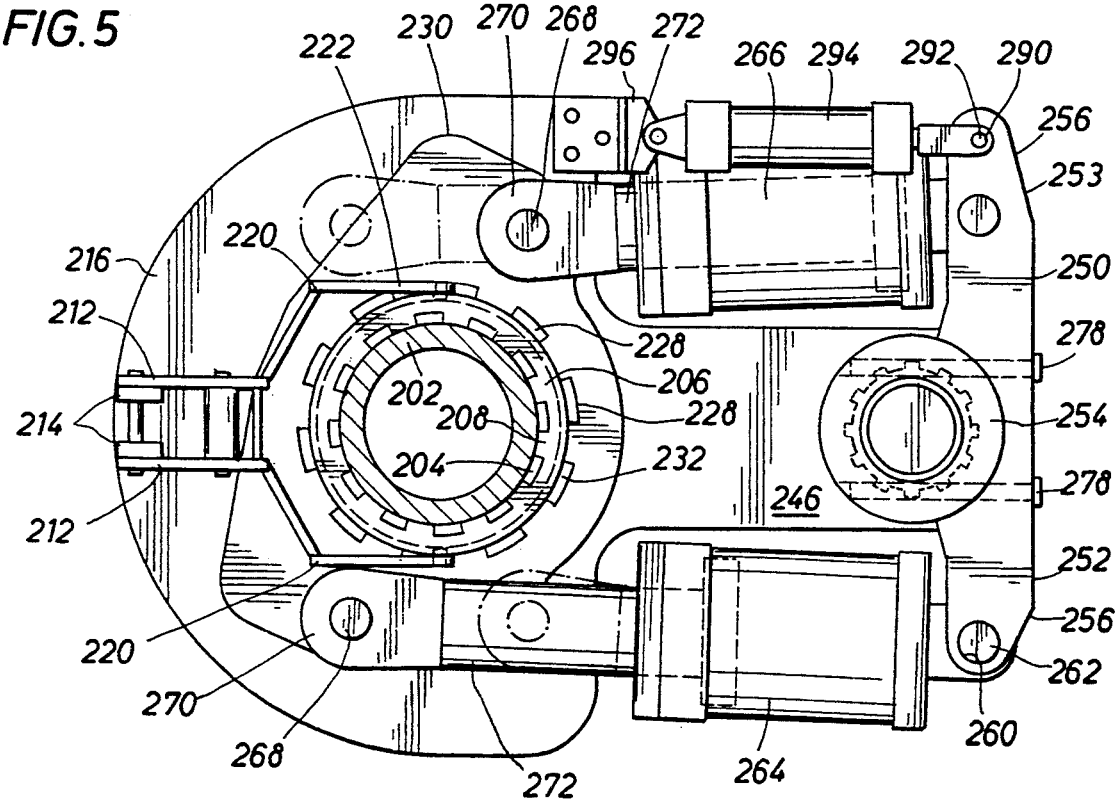
FIG. 5 is a view similar to FIG. 4 showing the initial positioning of the torquing device assembly of the torque break-out system, the dashed lines showing the final position of the cylinder rams after breaking the joint.
Figure 6:
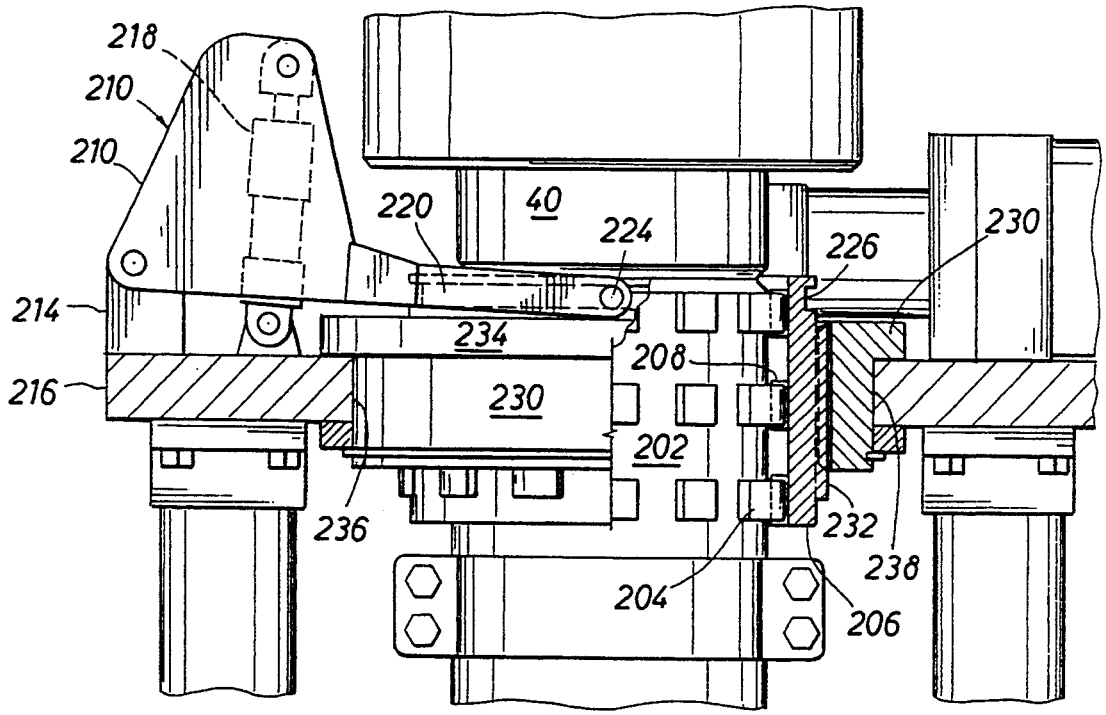
FIG. 6 is a side elevational view in partial section of the upper portion of the torque break-out system.

Referring to FIGS. 3, 4, 5 and 6, the interrupted splined collar 206 is hydraulically raised and lowered by a lift assembly 210. The lift assembly 210 includes a pivot member 212 which is pivotally connected to a pair of stanchions 214 mounted to a lower housing 216. The pivot member 212 is pin-connected to a lift cylinder 218 which is pivotally connected to the lower housing 216. The pivot member 212 includes a pair of arms 220 which extend forwardly and outwardly from the pivotally connected end of the pivot member 212. The pair of arms 220 terminate at a forward end 222 with an inwardly protruding pin 224 which is received in an exterior collar groove 226 of the interrupted splined collar 206. The pins 224 are maintained in the collar groove 226 by the arms 220. Referring to FIGS. 3 and 6, the first and second positions of the interrupted splined collar 206 are illustrated respectively. In the first position as shown in FIG. 3, the lift cylinder 218 is extended which forces the forward pair of arms 220 to an elevated position. The inwardly protruding pins 224 of the arms 220 which are received in the collar groove 226 raise the collar 206 to the elevated position in which the interrupted splines 204 and 208 are not in the same horizontal plane. In the second position as shown in FIG. 6, the lift cylinder 218 is retracted which lowers the forward pair of arms 220 and thus lowers the collar 206 such that the interrupted splines 204 and 208 are in the same horizontal plane.

Figure 9:
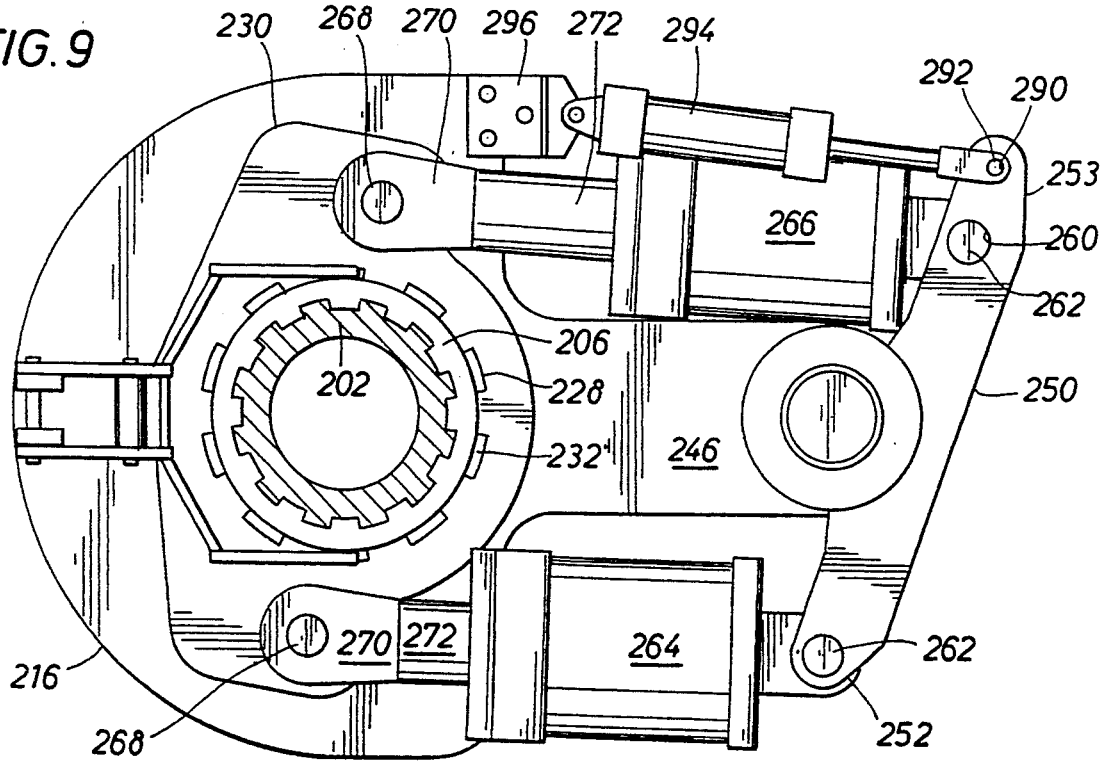
FIG. 9 is a view similar to FIGS. 4 and 5 showing the position of the torquing device assembly after breaking the joint when the power swivel resists rotation.

Referring to FIGS. 4, 5, and 9, the outer periphery of the interrupted splined collar 206 is vertically received by a torque plate 230 having a plurality of vertical slots 228 which receive corresponding keys 232 formed in the outer periphery of the collar 206. The keys 232 engage the slots 228 to maintain rotational relationship between the collar 206 and the torque plate 230 while permitting relative vertical movement between the two components, as shown in FIGS. 3 and 6.

The torque plate 230 has an upper flange 234 which rotatably rests on top of the lower housing 216 as shown in FIGS. 3 and 6. The lower housing 216 includes a circular opening 236 corresponding to the diameter of a circular lower portion 238 of the torque plate 230. Thus, the torque plate 230 is allowed to rotate relative to the lower housing 216. A spacer 240 and a retaining ring 242 are positioned beneath the lower housing 216 and restrict the vertical movement of the torque plate 230 relative to the lower housing 216. The retaining ring 242 is seated in a peripheral groove 244 in the lower portion 238 of the torque plate 230.

The lower housing 216 includes a neck portion 246 having a circular torque tube bore 248 for receiving the upper end 104 of the torque tube 102, as shown in FIG. 3. The upper end 104 of the torque tube 102 includes a splined portion 106 before terminating in a reduced diameter smooth cylindrical portion 108. The splined portion 106 matingly engages a splined sleeve 254 of a cylinder pivot 250. It is to be understood that while a splined connection is shown and described, other connecting means, as for example a keyed connection, could also be used. The cylinder pivot 250 includes a pair of arms 252, 253, as shown in FIGS. 4, 5, and 9. As shown in FIG. 2, each arm 252, 253 has an upper jaw 256 and a lower jaw 258. Referring to FIGS. 4, 5, and 9, each upper and lower jaw 256, 258 includes a port 260 for receiving a cylinder pin 262. A first torque cylinder 264 is pin-connected to one arm 252 and a second torque cylinder 266 is connected to the opposite arm 253. A pair of cylinder studs 268 extend upwardly from the torque plate 230. A male clevis 270 is attached to the end of each cylinder rod 272. The male clevis 270 fits down around the cylinder stud 268 and is held in place by a retaining ring (not shown) secured to the upper end of the cylinder stud 268.

The splined portion 106 of the upper end 104 of the torque tube 102 includes a circumferential recess 110, as shown in FIG. 3. A pair of holes 276 in the cylinder pivot 250 extend from the rear of the cylinder pivot 250 and into the splined sleeve 254, so that the holes 276 tangentially align with the circumferential recess 110 when the torque tube 102 is inserted in the splined sleeve 254 of the cylinder pivot 250. A retainer bolt 278 is inserted into the hole 276 at the rear of the cylinder pivot 250. The retainer bolt 278 is tangentially received in the circumferential recess 110 which restricts the vertical movement of the torque tube 102 relative to the cylinder pivot 250, as shown in FIGS. 3, 4, and 5.

Referring to FIG. 3, the smooth, upper cylindrical portion 108 of the torque tube 102 is received in an opening 282 of an upper housing 280. The upper housing 280 is rotatably attached to the power swivel 22 by a ball bearing assembly 25. It is to be understood that the upper housing 280 is securely attached to the lower housing 216 by brackets. One such housing bracket 286 is shown in FIG. 2 spanning between the upper housing 280 and the lower housing 216.

Referring to FIGS. 4, 5, and 9, the arm 253 of the cylinder pivot 250 includes an orifice 290 for receiving a cylinder pin 292. A torque plate return cylinder 294 is pin-connected to the arm 253 at one end and pin-connected to a return cylinder bracket 296 at a second end of the return cylinder 294. The return cylinder bracket is fastened to the lower housing 216.

Figure 7:
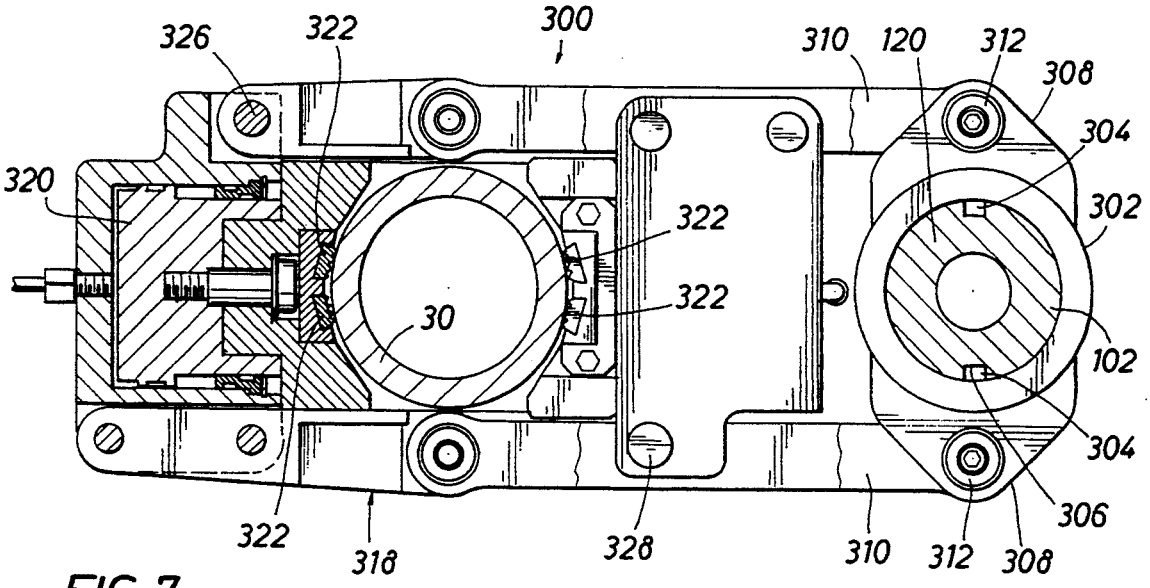
FIG. 7 is a partial section view of the back-up wrench assembly taken along line 7—7 of FIG. 2.
Figure 8:
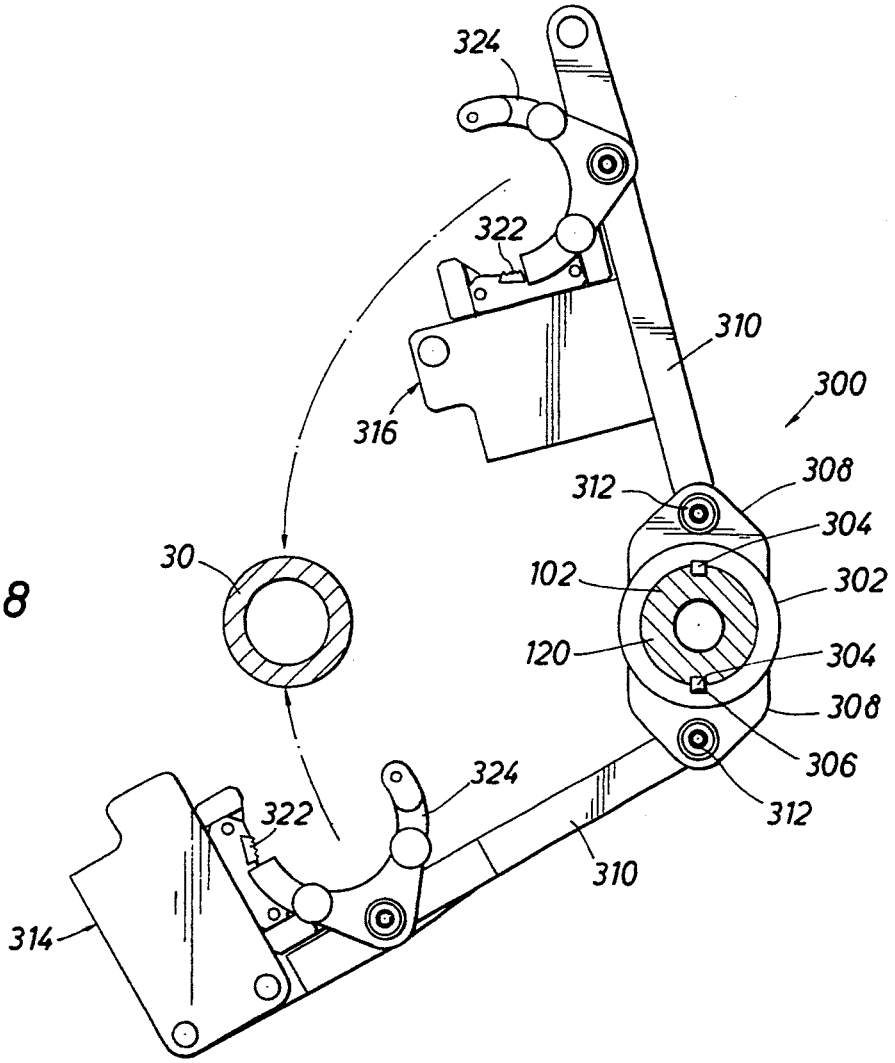
FIG. 8 is a plan elevational view of the back-up wrench assembly in an open position.

Referring to FIGS. 1, 2, 7, 8, and 10, the back-up wrench assembly 300 at the lower end of the torque tube 102 will now be described in detail. As shown in FIGS. 7 and 8, the back-up wrench assembly 300 includes a sleeve 302 having a plurality of keys 304 attached thereto. The keyed sleeve 302 engages with a lower portion 120 of the torque tube 102 having mating keyways 306. It is to be understood that while a keyed connection is shown and described, other connecting means, as for example a splined connection, could also be used. As shown in FIGS. 2, 7, and 8, pairs of ears 308 are attached to the sleeve 302 in diametrically opposed relationship with one another. Torque couple arms 310 are pivotally connected by pins 312 to the ears 308. At the distal end of the torque couple arm 310 is a drill string receiver assembly 312 having two mating half sections 314 and 316 as shown in FIG. 8. Each mating half section 314, 316, includes a housing 318 which is pivotally connected to the distal end of the torque couple arms 310. The mating half sections 314, 316 includes an hydraulically operated ram 320 which can be activated to firmly engage the drill string 30 with a set of dies 322 attached to the ram 320. Each mating half section 314, 316 includes a split ring 324 for receiving the drill string 30 as shown in FIG. 8. The two mating half sections 314, 316 are opened and closed by inserting and removing pins 326 and 328 shown in FIG. 7.

Figure 11:
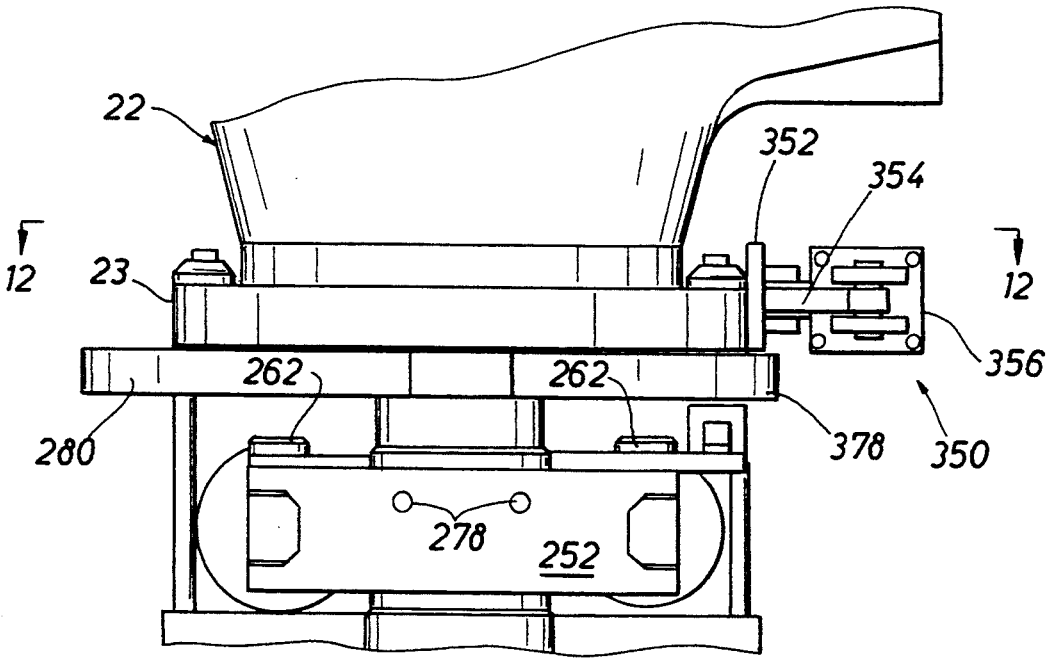
FIG. 11 is a side elevational view of a positioner cylinder assembly.

A positioner assembly 350 will now be described in detail with reference to FIGS. 11, 12, and 13. It is to be understood that the positioner assembly has been omitted from FIGS. 1 and 2. The positioner assembly 350 is mounted to a peripheral plate 23 attached to the power swivel 22. As shown in FIG. 3, the upper housing 280 is rotatably suspended from the peripheral plate 23 via the ball bearing assembly 25. The upper housing 280 is thus allowed to rotate relative to the power swivel 22. The positioner assembly 350 includes a cylinder bracket 352 which is mounted to the peripheral plate 23. The cylinder bracket 352 includes a cylinder mounting arm 354 having a hole (not shown) for pin-connecting a positioner cylinder 356 thereto. In the preferred embodiment, the positioner cylinder 356 is a pneumatic cylinder. At the opposite end of the cylinder bracket is a pair of pivot support members 358 having a hole 360 for receiving a pin 362. A hinge member 364 is generally L-shaped and is pin-connected to the pair of pivot support members 358 with the pin 362. A first end 366 of the hinge member 364 is pin-connected to the ram 368 of the positioner cylinder 356. A second end 370 of the hinge member 364 has a hole 372 for receiving a shaft 374 mounted to a cam follower 376..

Figure 12:
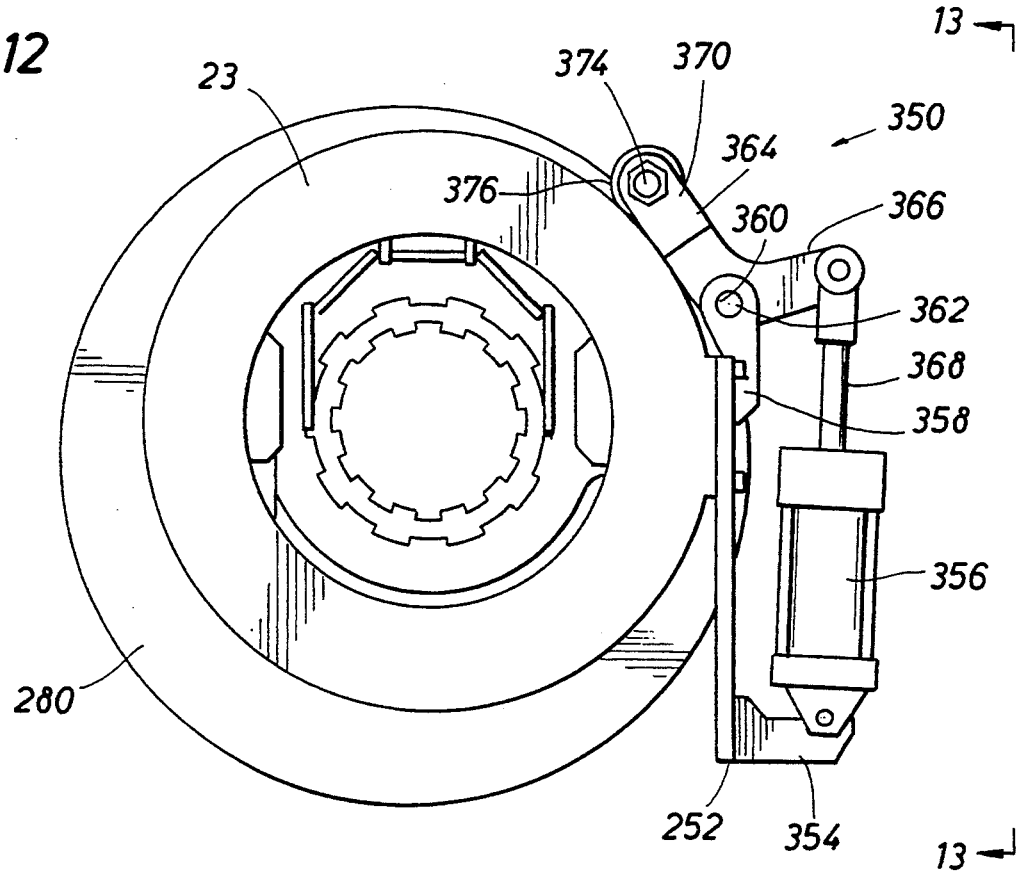
FIG. 12 is a view taken along line 12—12 of FIG. 11.
Figure 13:
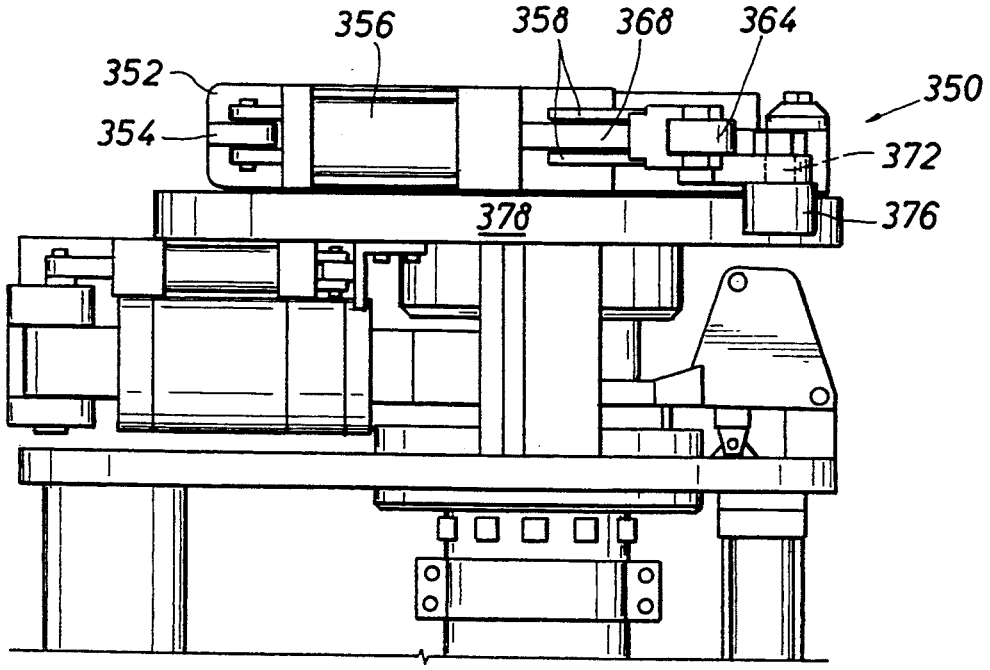
FIG. 13 is a view taken along line 13—13 of FIG. 12.

Referring to FIG. 12, the upper housing 280 is not concentrically positioned relative to the peripheral plate 23. As shown in FIG. 12, any rotation of the upper housing 280 relative to the peripheral plate 23 results in the cam follower 376 rolling along the edge 378 of the upper housing 280 and causing the hinge member 364 to pivot towards the positioner cylinder 356. The cylinder ram 368 is forced into the cylinder 356 where it is opposed by the pneumatic pressure in the cylinder 356. Thus, when the rotating forces on the upper housing 280 are eliminated, the positioner cylinder 356 exerts a counterclockwise rotation on the hinge member 364 which forces the upper housing 280 to return to its initial position.

Operation of the Invention

During routine drilling operations, the torque break-out system 100 is in the first position, as shown in FIG. 3. In the first position, the lift cylinder 218 is extended to its uppermost position so that the pair of arms 220 of the pivot member 212 lift the interrupted splined collar 206 to its topmost position. In the topmost position, the interrupted splines 208 and 204 of the collar 206 and the sub 202, respectively, do not engage each other as the power swivel 22 rotates the swivel stem 40, the interrupted splined sub 202 and the drill string 30 as in the drilling mode. Furthermore, in the topmost position, the keys 232 in the collar 206 remain in the vertical slots 228 of the torque plate 230 to restrict any rotational movement of the collar 206 relative to the torque plate 230. The torque plate 230 and the first and second torque cylinders 264 and 266, respectively, are preferably in the position as shown in FIG. 5 for reasons which will be explained below.

Referring to FIG. 7, the rams 320 are retracted during the routine drilling operation so that the drill string 30 is free to rotate within the back-up wrench assembly 300 without any interference by the dies 322.

To disconnect the joint or break-out the top drive drilling unit 20 from the drill string 30 after drilling has stopped, the lift cylinder 218 is fully retracted as shown in FIG. 6 after the power swivel 22 has stopped all rotation of the interrupted splined sub 202. Depending on the vertical alignment of the interrupted splines 204 and 208, it may be necessary to rotate the collar 206 as shown in FIG. 5 to a position in which the interrupted splines 208 of the collar 206 are not vertically aligned with the interrupted splines 204 of the interrupted splined sub 202. The collar 206 is rotated by the first and second torque cylinders 264 and 266, respectively, until the interrupted splines 204 and 208 are horizontally engaged with each other. The hydraulically operated rams 320 are activated to engage the dies 322 with the outer surface of the tool joint of the drill string 30, as shown in FIG. 7. Preferably, a pressure in the range of 1,500–2,000 psi is applied to the drill string 30 in order to prevent any rotational slippage between the dies 322 and the drill string 30.

The first and second torque cylinders 264 and 266 are activated to apply rotational torque to the torque plate 230. The cylinder pivot 250 is substantially restrained against rotation due to the splined connection to the torque tube 102. The torque tube 102 is restrained against rotation by the connection with the back-up wrench assembly 300 which is grippingly engaging the drill string 30. Thus, the back-up wrench assembly 300, the torque tube 102, and the cylinder pivot 250 are restrained against rotation by the firm engagement with drill string 30 by the dies 322. The first and second torque cylinders 264 and 266 apply rotational torque to the torque plate 230 in a direction that will unthread the threaded joint of the saver sub 42 and the upper joint of the drill string 30. In normal drilling operations, the rotational torque would be applied in a counter-clockwise direction to unthread the joint. For example, in FIG. 5 the torque plate 230 has been rotated to a position which allowed the interrupted splines 204 and 208 to be horizontally aligned and engaged. To break the threaded connection the first torque cylinder 264 is retracted and the second torque cylinder 266 is extended as shown by the dashed lines. The counter-clockwise rotation of the torque plate results in the counter-clockwise rotation of the collar 206 and the interrupted splined sub 202. The threaded connections between the interrupted splined sub 202 and the lower saver sub 42 are made up such that they require a higher torsional force to break these connections than the threaded connection between the lower saver sub 42 and the upper pipe joint of the drill string 30. For example, the intermediate threaded connections may require torsional forces in excess of 60,000 ft-lbs. due to the thread type, material type, and the force applied in making the joint. Typically, the force required to break the joint between the lower saver sub 42 and the drill string 30 will be in the range of 15,000 to 20,000 ft-lbs. Thus, as the rotational torque is applied to the torque plate 230, the threaded joint of least resistance is the joint between the lower saver sub 42 and the drill string 30.

Preferably, the first and second torque cylinders 264 and 266 operate synchronously, i.e., the extending or "pushing" force applied by the second torque cylinder is substantially equivalent to the retracting or "pulling" force applied by the first torque cylinder 264. The synchronized torque cylinders 264 and 266 substantially form a couple, i.e., two equal and opposite forces acting along parallel lines. This arrangement substantially eliminates any friction forces and bending stresses in the torque break-out system 100 during its operation.

Figure 10:
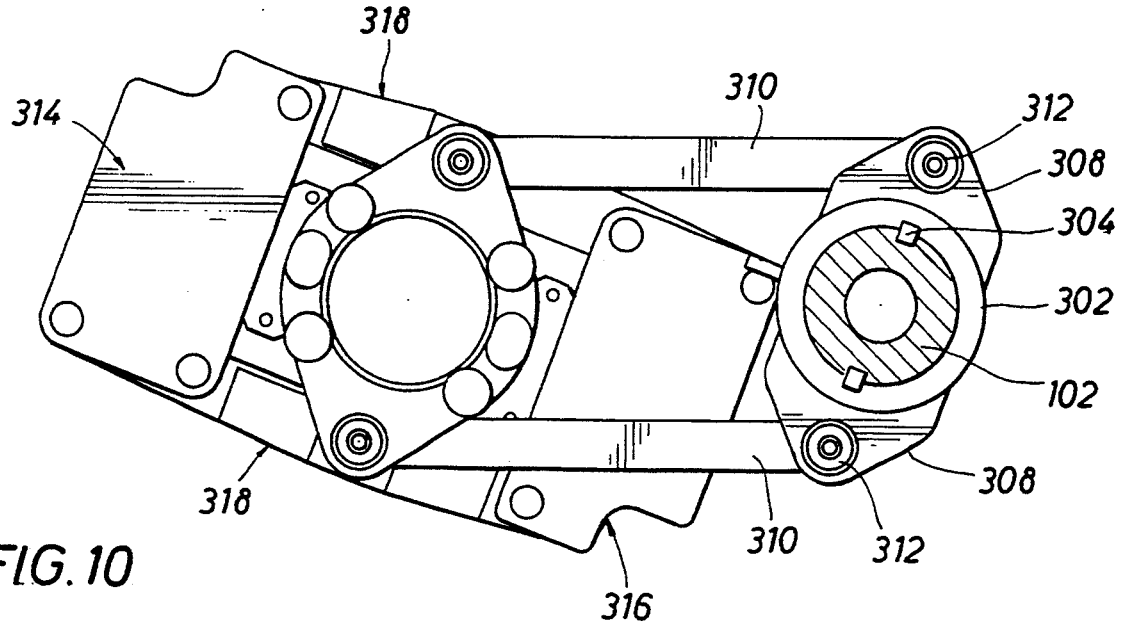
FIG. 10 is a view of the back-up wrench assembly showing the position of the back-up wrench assembly after breaking the joint when the power swivel resists rotation.

Referring to FIGS. 9 and 10, these figures illustrate the position of the torquing device assembly 200 after breaking the joint when the power swivel 22 resists rotation. When this situation arises, the torque plate return cylinder 294 is utilized to return the cylinder pivot 250 and the back-up wrench assembly 300 to their original normal position. In the preferred embodiment, the torque plate return cylinder 294 is a $1\frac{1}{2}''$ diameter hydraulic cylinder having a $3\frac{3}{4}''$ stroke.

Although not limited to the following, the torque break-out system 100 according to the present invention may be utilized with a 500 hp. top drive drilling unit capable of drilling to a depth of approximately 14,000 feet. With this capacity drilling unit, a maximum torque of 60,000 ft-lbs. on the torque plate 230 can be provided with a $5\frac{1}{4}''$ diameter first torque cylinder 264 and a 6" diameter second torque cylinder 266. The cylinders 264 and 266 are preferably sized accordingly so that the same hydraulic pressure applied to each of the cylinders 264 and 266 results in equal and opposite forces applied to the torque plate 230. It is to be understood that a hydraulic cylinder develops a different force when extending than when retracting, even though the same hydraulic pressure is supplied to the hydraulic cylinder. Thus, the two torque cylinders 264 and 266 are sized accordingly to apply equal forces when under the load of breaking the threaded connection.

The foregoing disclosure and description of the invention is illustrative and explanatory thereof, and various changes in the size, shape, and materials, as well as in the details of illustrative construction and assembly, may be made without departing from the spirit of the invention.

I claim:

1. A torque break-out system for a top drive drilling unit in a drilling rig, the top drive drilling unit having a non-rotating outer housing and adapted to be received at the upper end of a drill string, the top drive drilling unit is moveable upwardly and downwardly with the drill string and includes a tubular stem adapted to be connected to the upper end of the drill string for rotation therewith and a motor for power rotating the tubular stem and the connected drill string, the torque break-out system comprising:

an upper housing rotatably connected to the non-rotating outer housing of the top drive drilling unit;

a torquing assembly connected to said upper housing; and a wrench assembly fixedly connected to said torquing assembly, said wrench assembly vertically fixed relative to the tubular stem.

2. The system according to claim 1, wherein said torquing assembly comprises:

a sub connected to the tubular stem, said sub having a plurality of splines;

a collar having a plurality of splines in reciprocal relationship to said splines of said sub; and means for displacing said collar between a first position wherein said collar splines are disengaged with said sub splines and a second position wherein said collar splines are engaged with said sub splines.

3. The system according to claim 2, wherein said sub splines and said collar splines are interrupted splines and said collar is positioned circumferentially around said sub, and wherein in said first position said collar interrupted splines are not in substantial horizontal alignment with said sub interrupted splines and in said second position said collar interrupted splines are in substantial horizontal alignment with said sub interrupted splines.

4. The system according to claim 2, wherein said means for displacing comprises:

a pivot member connected to said collar; and a lift cylinder connected to said pivot member, wherein said lift cylinder displaces said collar between said first and second positions.

5. The system according to claim 4, wherein said collar is permitted to rotate relative to said pivot member.

6. The system according to claim 4, wherein said pivot member has a pair of arms connected to said collar.

7. The system according to claim 1, wherein said wrench assembly comprises:

a framework having a vertical opening therethrough adapted to receive the drill string;

an extendible ram attached to said framework;

a plurality of dies attached to said framework and said ram, wherein said ram is capable of extending towards the drill string so that the drill string is grippingly engaged by said plurality of dies.

8. The system according to claim 2, wherein said wrench assembly is fixedly connected to said torquing assembly by a torque member having an upper end and a lower end, said lower end fixedly connected to said wrench assembly, said torquing assembly further comprising:

a cylinder pivot member fixedly connected to said upper end of said torque member; and first and second torque cylinders each having a first end connected to said cylinder pivot member and a second end connected to said collar.

9. The system according to claim 8, wherein said torque member has a longitudinal axis and is allowed to slightly rotate about its longitudinal axis.

10. The system according to claim 1, further comprising a positioner assembly for returning said upper housing to an initial orientation.

11. The system according to claim 10, wherein said upper housing is a camming member having a camming edge surface, said positioner assembly comprising:

a positioner cylinder connected to the outer housing, said positioner cylinder having a cylinder ram; and a hinge member pivotally connected to the outer housing and having a first end and a second end, said cylinder ram connected to said first end of said hinge member and said second end of said hinge member adapted to contactingly engage said camming edge surface of said upper housing, wherein said upper housing is allowed to rotate when subjected to rotational forces and returns to an initial orientation when rotational forces are eliminated.

12. The system according to claim 11, wherein said positioner cylinder is a pneumatic cylinder.

13. The system according to claim 11, wherein said second end of said hinge member includes a cam follower which rolls along said camming edge surface.

14. A torque break-out system for a top drive drilling unit in a drilling rig, the top drive drilling unit having a non-rotating outer housing and adapted to be received at the upper end of a drill string, the top drive drilling unit is moveable upwardly and downwardly with the drill string and includes a tubular stem adapted to be connected to the upper end of the drill string for rotation therewith and a motor for power rotating the tubular stem and the connected drill string, the torque break-out system comprising:

an upper housing rotatably connected to the non-rotating outer housing of the top drive drilling unit;

a wrench assembly connected to said upper housing, said wrench assembly adapted to grippingly engage the drill string;

a tubular sub adapted to be threadably connected to the tubular stem, said tubular sub having a plurality of exterior splines;

a collar having a plurality of interior splines adapted to interconnect with said exterior splines;

means for displacing said collar vertically relative to said wrench assembly between a first position wherein said collar interior splines are disengaged with said sub exterior splines and a second position wherein said collar interior splines are engaged with said sub exterior splines;

means for rotating said tubular sub relative to the drill string; and a positioner assembly for returning said upper housing to an initial horizontal orientation.

15. The system according to claim 14, wherein said sub exterior splines and said collar interior splines are interrupted splines and said collar is positioned circumferentially around said sub, and wherein in said first position said collar interior splines are not in substantial horizontal alignment with said sub exterior splines and in said second position said collar interior splines are in substantial horizontal alignment with said sub exterior splines.

16. The system according to claim 14, wherein said means for displacing comprises:

a pivot member connected to said collar; and a lift cylinder connected to said pivot member, wherein said lift cylinder displaces said collar between said first and second positions.

17. The system according to claim 16, further comprising means for permitting rotation of said collar relative to said pivot member.

18. The system according to claim 16, wherein said pivot member has a pair of arms connected to said collar.

19. The system according to claim 14, wherein said wrench assembly comprises:

a framework having a vertical opening therethrough adapted to receive the drill string;

an extendible ram attached to said framework;

a plurality of dies attached to said framework and said ram, wherein said ram is capable of extending towards the drill string so that the drill string is grippingly engaged by said plurality of dies.

20. The system according to claim 14, wherein said wrench assembly is connected to said upper housing by a torque member having an upper end and a lower end, said lower end fixedly connected to said wrench assembly, said means for rotating comprising:

a cylinder pivot member fixedly connected to said upper end of said torque member; and first and second torque cylinders each having a first end connected to said cylinder pivot member and a second end connected to said collar.

21. The system according to claim 20, wherein said torque member has a longitudinal axis and is allowed to slightly rotate about its longitudinal axis.

22. A torque break-out system for a top drive drilling unit in a drilling rig, the top drive drilling unit having a non-rotating outer housing and adapted to be received at the upper end of a drill string, the top drive drilling unit is moveable upwardly and downwardly with the drill string and includes a tubular stem adapted to be connected to the upper end of the drill string for rotation therewith and a motor for power rotating the tubular stem and the connected drill string, the torque break-out system comprising:

an upper housing rotatably connected to the non-rotating outer housing of the top drive drilling unit, said upper housing including a camming member having a camming edge surface;

a wrench assembly connected to said upper housing, said wrench assembly adapted to grippingly engage the drill string;

a tubular sub adapted to be threadably connected to the tubular stem, said tubular sub having a plurality of exterior splines;

a collar having a plurality of interior splines adapted to interconnect with said exterior splines;

means for displacing said collar between a first position wherein said collar interior splines are disengaged with said sub exterior splines and a second position wherein said collar interior splines are engaged with said sub exterior splines, wherein said collar moves vertically relative to said wrench assembly;

means for rotating said tubular sub relative to the drill string; and a positioner assembly for returning said upper housing to an initial orientation, said positioner assembly comprising:

a positioner cylinder connected to the outer housing, said positioner cylinder having a cylinder ram; and a hinge member pivotally connected to the outer housing and having a first end and a second end, said cylinder ram connected to said first end of said hinge member and said second end of said hinge member adapted to contactingly engage said camming edge surface of said upper housing, wherein said upper housing is allowed to rotate when subjected to rotational forces and returns to the initial orientation when rotational forces are eliminated.

23. The system according to claim 22, wherein said positioner cylinder is a pneumatic cylinder.

24. The system according to claim 22, wherein said second end of said hinge member includes a cam follower which rolls along said camming edge surface.

25. A torque break-out system for a top drive drilling unit in a drilling rig, the top drive drilling unit having a non-rotating outer housing and adapted to be received at the upper end of a drill string, the top drive drilling unit is moveable upwardly and downwardly with the drill string and includes a tubular stem adapted to be connected to the upper end of the drill string for rotation therewith and a motor for power rotating the tubular stem and the connected drill string, the torque break-out system comprising:

an upper housing rotatably connected to the non-rotating outer housing of the top drive drilling unit;

a torquing assembly connected to said upper housing;

a torque member having a longitudinal axis and an upper end and a lower end, said upper end fixedly connected to said torquing assembly;

a wrench assembly fixedly connected to said lower end of said torque member; and means for allowing said torque member to slightly rotate about its axis independently of said upper housing while maintaining the same positional relationship with the longitudinal axis of the drill string.

26. The system according to claim 25, wherein said torquing assembly further comprises:

a sub connected to the tubular stem;

a collar adapted to non-rotatably engage said sub;

a cylinder pivot member fixedly connected to said upper end of said torque member; and a torque cylinder having a first end connected to said cylinder pivot member and a second end connected to said collar.

27. The system according to claim 25, wherein said wrench assembly comprises:

a framework having a vertical opening therethrough adapted to receive the drill string;

means for grippingly engaging the drill string, said engaging means connected to said framework;

wherein said means for engaging is allowed to slightly rotate about the longitudinal axis of the drill string as said torque member slightly rotates about its longitudinal axis without altering the horizontal positioning of said torque member with respect to the drill string.

28. The system according to claim 27, wherein said means for engaging comprises:

an extendible ram attached to said framework;

a plurality of dies attached to said framework and said ram, wherein said ram is capable of extending towards the drill string so that the drill string is grippingly engaged by said plurality of dies.

29. The system according to claim 27, wherein said wrench assembly further comprises a pair of torque couple arms, each said torque couple arms having a first end pin-connected to said torque member and a second end pin-connected to said framework.

* * * * *